US009447598B2

(12) United States Patent
Pereira et al.

(10) Patent No.: US 9,447,598 B2
(45) **Date of Patent: *Sep. 20, 2016**

(54) RAPID DEPLOY GUY SYSTEM

(71) Applicant: US Tower Corporation, Lincoln, KS (US)

(72) Inventors: Kenneth Pereira, Woodlake, CA (US); Bruce Kopitar, Woodlake, CA (US)

(73) Assignee: US Tower Corporation, Linconln, KS (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/873,953

(22) Filed: Oct. 2, 2015

(65) Prior Publication Data

US 2016/0040447 A1 Feb. 11, 2016

Related U.S. Application Data

(63) Continuation of application No. 14/032,981, filed on Sep. 20, 2013, now Pat. No. 9,150,380, which is a continuation of application No. 13/284,699, filed on Oct. 28, 2011, now Pat. No. 8,627,614.

(60) Provisional application No. 61/407,560, filed on Oct. 28, 2010.

(51) Int. Cl.
*E04H 12/20* (2006.01)
*B65H 59/40* (2006.01)

(52) U.S. Cl.
CPC ..... *E04H 12/20* (2013.01); *B65H 59/40* (2013.01)

(58) Field of Classification Search
CPC ..... B65H 59/40; E04H 12/20; Y10T 403/32991; Y10T 403/5726
USPC ..... 52/146, 148, 149, 223.14, 291, 152, 52/573.1, 223.13, 105; 267/69, 70, 71, 72, 267/73, 1, 174, 175, 77, 179, 287, 291, 267/293; 24/71.1; 403/304, 166
See application file for complete search history.

(56) References Cited

U.S. PATENT DOCUMENTS 364,077 A * 5/1887 Addis ..... E04H 12/20 256/DIG. 2
453,573 A * 6/1891 Beery ..... B61H 15/0064 111/49
530,758 A * 12/1894 Finter ..... F16F 1/128 267/71
568,083 A * 9/1896 Davidson ..... F16F 1/128 267/71
762,008 A * 6/1904 Stoner ..... E04H 12/20 256/35
775,335 A * 11/1904 Le Hew ..... E04H 17/08 256/35
837,912 A * 12/1906 Brown ..... E04H 12/34 254/398

(Continued)

*Primary Examiner* — Adriana Figueroa
*Assistant Examiner* — Jessie Fonseca
(74) *Attorney, Agent, or Firm* — Leech Tishman Fuscaldo & Lampl; Kenneth D'Alessandro, Esq.

(57) ABSTRACT

A tension assembly indicates when a desired tension is achieved between two objects connected by the tension assembly. The tension assembly may be attached in series with a tension adjustor between a structure and an anchor, or any other two objects, and include a compressible component and an indication mechanism. As tension between the structure and anchor is adjusted using the tension adjustor, the compressible component adjusts in size, allowing the indicator to indicate whether the current tension is satisfactory. The compressible component includes a spring which, when compressed or expanded, allows the indicator to move toward or away from another indicator. When the indicators are aligned, the desired tension is achieved.

9 Claims, 6 Drawing Sheets

(56) References Cited

U.S. PATENT DOCUMENTS 939,618 A * 11/1909 Neller et al. ..... E04H 12/24 52/149
1,257,699 A * 2/1918 Gray ..... E04H 12/182 182/145
1,262,301 A * 4/1918 Blest ..... B61D 17/06 105/411
1,281,201 A * 10/1918 Peterson ..... E04H 12/20 29/514
1,828,349 A * 10/1931 Williams ..... E01F 15/06 256/13.1
2,057,328 A * 10/1936 Cordova ..... E01D 19/16 14/22
2,128,030 A * 8/1938 Koleno ..... E04H 17/04 256/39
2,162,675 A * 6/1939 Lingo ..... H01Q 1/1235 343/875
2,401,799 A * 6/1946 Riemenschneider H01Q 1/1242 174/94 S
2,410,246 A * 10/1946 Scrivener ..... E04C 3/32 52/148
2,413,149 A * 12/1946 McCarthy ..... E21B 15/00 182/114
2,617,500 A * 11/1952 Cardwell ..... E21B 7/02 52/115
2,643,109 A * 6/1953 Wood ..... F16F 3/04 267/140.3
2,736,398 A * 2/1956 Peterson ..... E04H 12/20 174/45 R
3,119,471 A * 1/1964 Turner ..... E04H 12/10 411/337
3,250,527 A * 5/1966 Ramsey ..... B60D 1/182 267/70
3,343,858 A * 9/1967 Rice ..... F16C 7/04 267/70
3,368,319 A * 2/1968 Thomas ..... E04H 12/10 52/148
3,402,518 A * 9/1968 Lettunich ..... E04H 12/20 52/149
4,115,965 A * 9/1978 White ..... F16G 15/08 52/148
4,203,267 A * 5/1980 Langhorst ..... E04H 12/20 24/122.6
4,681,303 A * 7/1987 Grassano ..... A01K 27/005 119/769
4,800,690 A * 1/1989 Bunce ..... E04H 12/20 110/184
4,899,499 A * 2/1990 Hoekstra ..... E01F 13/028 403/78
4,955,309 A * 9/1990 Ciccone ..... B63B 21/20 114/230.24
5,482,258 A * 1/1996 Clauson ..... F16F 7/00 114/230.2
6,239,362 B1 * 5/2001 Nannini ..... B60M 1/26 174/40 TD
6,301,830 B1 * 10/2001 Whipple ..... A01G 17/04 47/43
6,668,498 B2 * 12/2003 Ritz ..... E04H 12/10 52/148
6,931,805 B2 * 8/2005 Gregory ..... E02D 37/00 52/146
6,948,290 B2 9/2005 Ritz
7,062,883 B1 * 6/2006 Langholz ..... E04H 12/182 52/110
7,097,154 B2 8/2006 Stevens
7,516,582 B2 * 4/2009 Leek ..... E04B 1/0007 411/231
7,685,788 B1 * 3/2010 Torres ..... E04B 1/2403 254/243
7,757,439 B1 * 7/2010 Ranieri ..... E04H 15/322 52/222
7,905,066 B2 * 3/2011 Pryor ..... E04B 1/26 267/154
2001/0000839 A1 * 5/2001 Ritz ..... E04H 12/10 52/146
2006/0151761 A1 * 7/2006 Stevens ..... B25B 25/00 254/232
2010/0008734 A1 * 1/2010 Stevens ..... E04H 12/20 405/244
2011/0016804 A1 * 1/2011 Howard ..... E04H 12/34 52/146

* cited by examiner

RAPID DEPLOY GUY SYSTEM

CROSS REFERENCE TO RELATED APPLICATION

This application is a continuation of U.S. patent application Ser. No. 14/032,981, filed Sep. 20, 2013, now U.S. Pat. No. 9,150,380, issued Oct. 6, 2015, which is a continuation of U.S. patent application Ser. No. 13/284,699 filed Oct. 28, 2011, now U.S. Pat. No. 8,627,614, issued Jan. 14, 2014, which claims the priority benefit of U.S. provisional patent application No. 61/407,560 filed on Oct. 28, 2010, the disclosures of which are incorporated herein by reference in their entirety.

BACKGROUND

Guy systems may be used to secure structures by increasing tension on one or more wires attached to the structure. Structures secured by guy systems may have an earth anchor that anchors the structure to the ground. One or more guy cables may then be attached to a portion of structure using a fully extended turnbuckle which is secured to a cable anchor. The turnbuckle was used to adjust the tension of each cable to a desired amount, and cable clamps were used to secure the turnbuckle setting. The tension was typically ten percent of the breaking point of the cable. The tension in a cable was typically measured with a tensiometer. Tensiometer readings are specific to guy cable diameter, and the reading is compared to a calibration card which is unique to the tensiometer the card is calibrated to.

A problem with the turnbuckle system of adjusting tension in guy cables is that after a first turnbuckle is tightened, tightening of a second turnbuckle on a second cable would increase the tension on the second turnbuckle, hence requiring readjustment of the tension of the second turnbuckle. When a structure is secured with three or four cables using turnbuckles, it can take hours to get the tension in each turnbuckle to the desired amount. Additionally, there are many opportunities to make errors in measuring tension when using a tensiometer and a calibrated card.

What is needed is an improved system for applying tension in a guy system.

SUMMARY OF THE INVENTION

The present technology includes a tension assembly which indicates when a desired tension is achieved between two objects connected by the tension assembly. The tension assembly may be attached in series with a tension adjustor between a structure and an anchor, or any other two objects, and include a compressible component and an indication mechanism. As tension between the structure and anchor is adjusted using the tension adjustor, the compressible component adjusts in size, allowing the indicator to indicate whether the current tension is satisfactory. The compressible component includes a spring which, when compressed or expanded, allows the indicator to move toward or away from another indicator. When the indicators are aligned, the desired tension is achieved.

A tension assembly device may include a first connector, a second connector, a housing, a compressible component and an indicator. The first connector may couple the tension assembly to an anchor. The second connector may couple the tension assembly to a structure to be secured. The housing may be connected to the first connector and a second connector. The compressible component may be disposed within the housing and be configured to compress when a tension adjustor increases the tension between the structure and the anchor. The indicator may be configured to indicate when a specific tension is created between the structure and the anchor by compressing the compressible component.

A guy system may include a structure, a guy cable, an anchor, a tension adjustor, and a tension assembly. The guy cable may be coupled to the structure and the anchor. The tension adjustor may be coupled with the cable between the structure and the anchor. The tension assembly device may be coupled between the anchor and the structure and may include a compressible component and an indicator. The compressible component may be configured to compress when a tension adjustor increases the tension between the structure and the anchor. The indicator may be within the tension assembly device and configured to indicate when a specific tension is created between the structure and the anchor by compressing the compressible component.

DETAILED DESCRIPTION

Embodiments of the present invention include a tension assembly which easily and reliably conveys when a desired tension is achieved between two objects connected to the tension assembly. The tension assembly may be attached with a tension adjustor between a structure and an anchor and include a compressible component and an indication mechanism. As tension between the structure and anchor is adjusted using the tension adjustor, the compressible component adjusts in size, allowing an indicator to indicate whether the tension is satisfactory. The compressible component includes a spring which, when compressed or expanded, allows an indicator to move towards or away from another indicator. When the indicators are aligned, the desired tension is achieved.

The tension assembly of the present invention provides for a quick, easy and reliable method for confirming a desired tension exists between two objects. The tension assembly is a single unit that does not require additional parts, charts, or components to measure the tension. The tension assembly also includes a mechanism for preventing over compression of the compression component due to sudden increases in tension due to wind or other forces.

Figure 1:
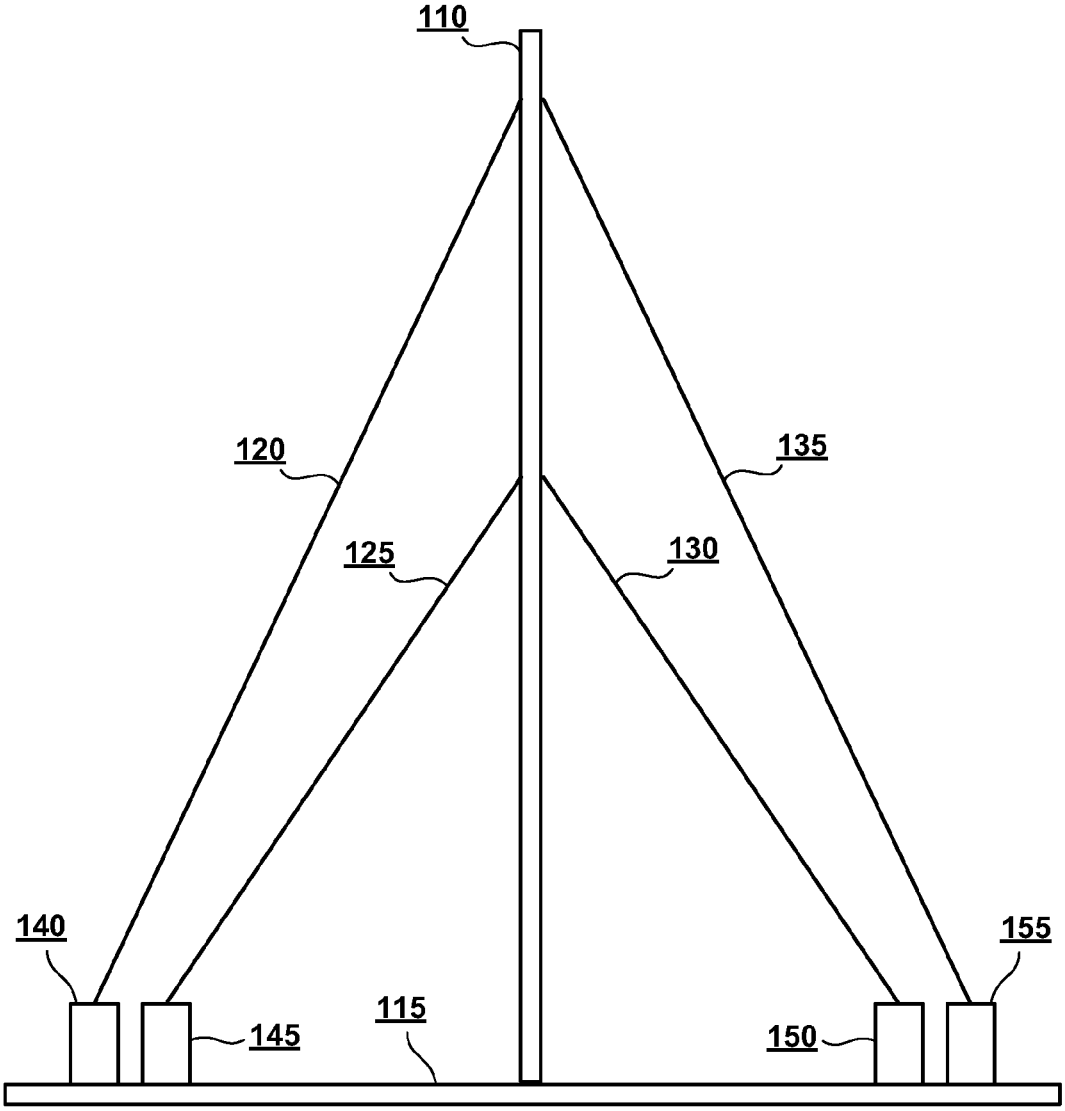
FIG. 1 illustrates an exemplary structure to secure using a guy system.

FIG. 1 illustrates an exemplary structure to secure using a guy system. Structure 110 may extend horizontally (or vertically, not shown) and may be secured by an anchor 115. In an embodiment, structure 110 may be a tower that is anchored by an earth anchor. A guy cables may be coupled to structure 110 and attached to a guy system. For example, guy cables 120, 125, 130 and 135 are attached guy systems 140, 145, 150 and 155, respectively. Each guy system may secure the cable and adjust the tension between an anchor and the structure to a desired level.

Figure 2:
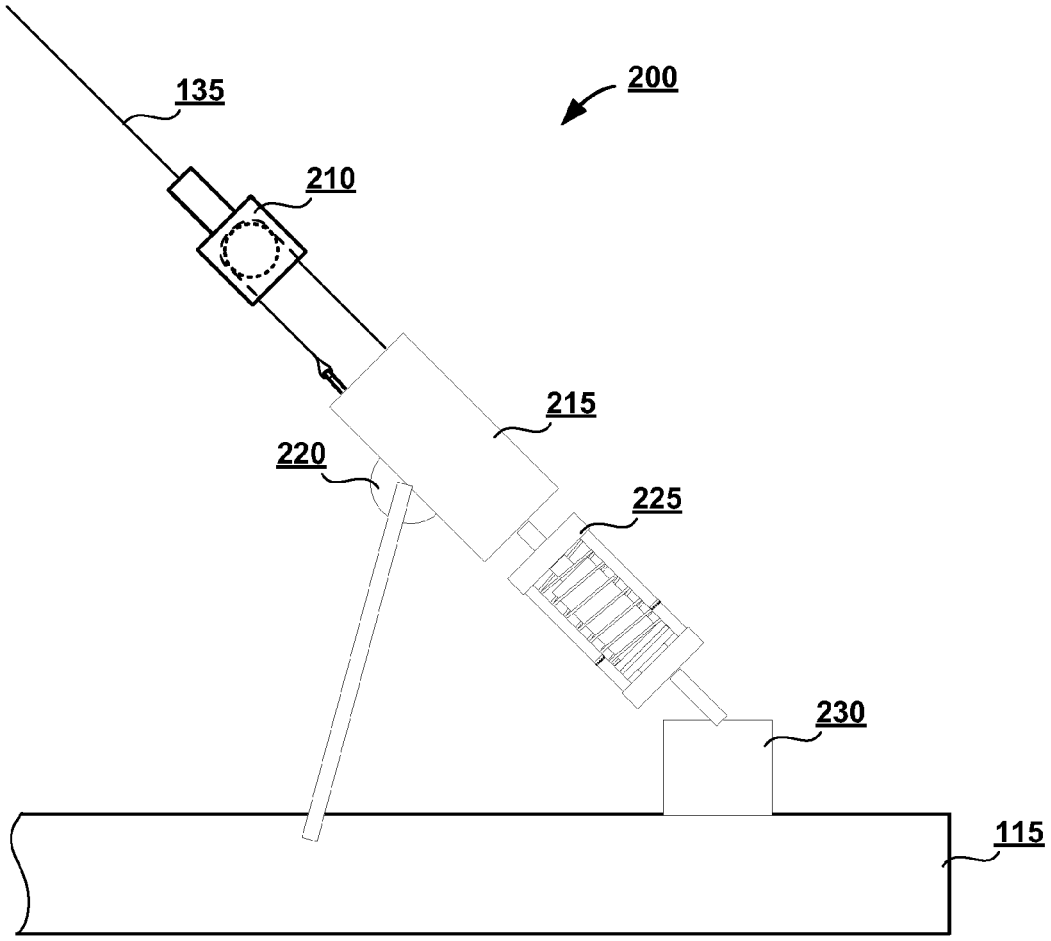
FIG. 2 illustrates an exemplary guy system.

FIG. 2 illustrates an exemplary guy system. Guy system 200 includes a pulley 210, a tension adjuster 215, a tension assembly 225, and anchor 230. Pulley 210 may be coupled to a guy cable which is coupled to structure 110. A cable run through pulley 210 may be coupled to tension adjustor 215.

Tension adjustor 215 may be coupled to anchor 230 via tension assembly 225 and structure 110 via pulley 210 and a guy cable and may increase the tension between the anchor and structure. For example, the tension adjustor 215 may be implemented with a come-along cable puller. Using the come-along, an operator may increase the tension between the structure and anchor by manipulating lever 220 of the come-along.

Tension assembly 225 may couple to the tension adjuster 215 and anchor 230. The tension assembly 225 may provide a visual indication of when the desired tension is reached between the structure 110 and anchor 230. The visual indication may be, for example, an alignment of a two marks on the tension assembly. The visual indication obviates the need for a tensiometer and provides a quick and simple way to determine if a proper tension exists between the structure 110 and anchor 230. A tension assembly 225 is discussed in more detail below with respect to FIGS. 3-4.

Figure 3:
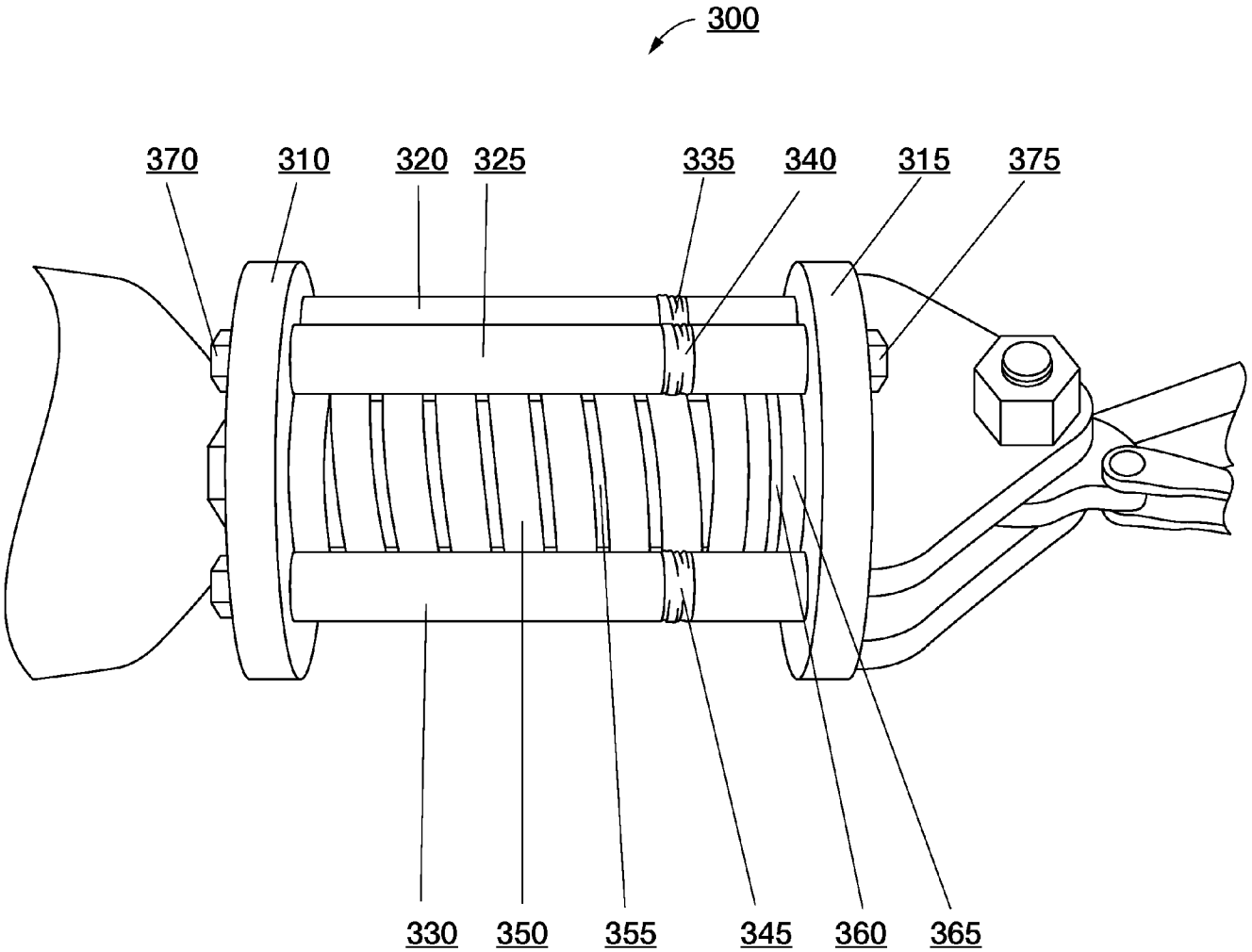
FIG. 3 illustrates an exemplary tension assembly without tension in a compressible component.

FIG. 3 illustrates an exemplary tension assembly 300 without tension in a compressible component. Tension assembly 300 includes front plate 310, rear plate 315, support members 320, 325 and 330, a spring 350, a spring carrier 355, and a spring carrier end 365. The housing of the tension assembly 200 is formed by support members 320, 325 and 330, front plate 310 and rear plate 315. Support members 320, 325 and 330 extend between front plate 310 and rear plate 315. The support members may be tubes, rods, or any structure suitable to maintain spacing between front plate 310 and rear plate 315. The support members may be attached to the front and/or rear plates by bolts 370 and 375 or some other securing mechanism.

The spring carrier 355 may extend through front plate 310 and may be coupled to spring carrier end 365. In some embodiments, spring carrier 355 may be attached to spring carrier end 365 and a component that extends through front plate 310. An end of spring carrier 355 may be attached or connected to a bolt of other mechanism which is coupled to a guy cable or tension adjustor 215. The spring carrier end may engage an inner surface of the rear plate 315. An outer surface of the spring carrier end may engage the inner surfaces of support members 320, 325 and 330 to guide the spring carrier along the length of the tension assembly as tension between a structure and anchor is adjusted by tension adjustor 215.

Spring 350 may be disposed over spring carrier 355 and may expand and compress as tension between structure 110 and anchor 230 changes. The inner surface of spring 350 may engage the outer surface of spring carrier 355 while the ends of spring 350 engage a side surface of the spring carrier end and an inner surface of front plate 310.

Indictors are located on the tension assembly to indicate when the tension between the structure and the anchor is at a specific level. The indicators may include an indicator on one or more of support members 320, 325 and 330 and another indicator that aligns with the first indicator when the desired tension is achieved. For example, indicators 335, 340 and 345 may exist on support members 320, 325 and 330, respectively. A second indicator may exist on spring carrier end 365. When there is no compression of spring 350, the spring carrier end is positioned against the rear plate inner surface and indicator 360 is not aligned with indicators 340, 335, and 345.

Figure 4:
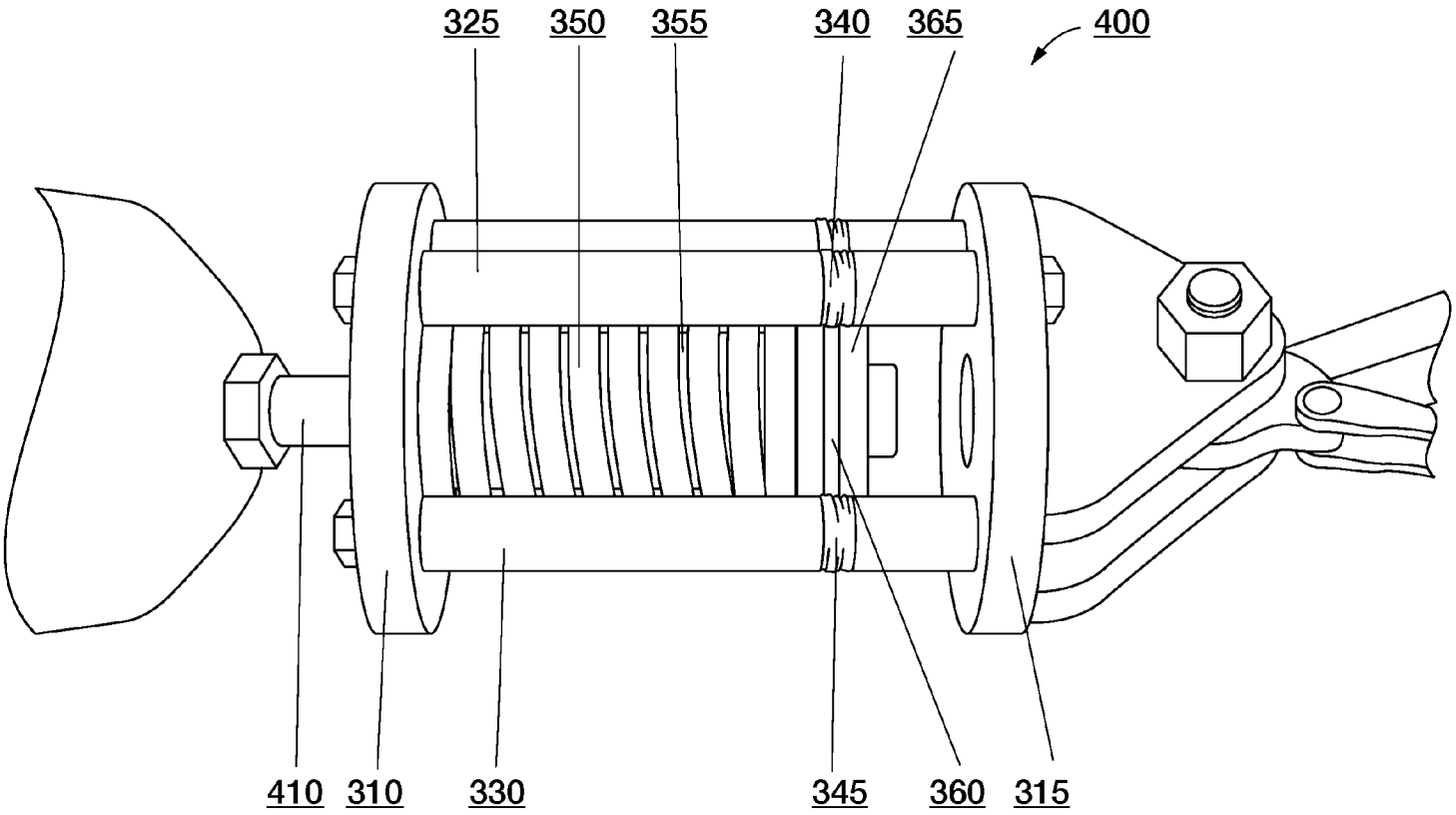
FIG. 4 illustrates an exemplary tension assembly at proper tension in a compressible component.

FIG. 4 illustrates an exemplary tension assembly 400 at proper tension in a compressible component. Tension assembly 400 includes front plate 310, rear plate 315, support members 325 and 330 (other support members may be hidden from view), spring 350, spring carrier 355, and a spring carrier end 365. As tension adjuster 215 adjusts the tension between structure 110 and anchor 230, spring carrier 355 is displaced towards front plate 310 as connector 410, coupled to spring carrier 350, is pulled towards tension adjustor 215. As spring carrier 350 is displaced towards front plate 310, spring 350 compresses and spring carrier end 365 is moved away from the inner edge of rear plate 315. Eventually, indicator 360 on spring carrier end 365 is moved along the central axis of tension assembly 400 until it aligns with indicators 340 and 345 on support members 325 and 330, respectively. Once the indicators on the support members and the spring carrier end are aligned, the desired tension is achieved between structure 110 and anchor 230.

In some embodiments, the tension between structure 110 and anchor 230 may be set to a fraction of the breaking point of a cable, such as a guy cable, used to couple the structure 110 and anchor 230. The fraction may be five percent, ten percent, twenty percent, or any other fraction. The spring may be selected such that it will compress by an amount such that the indicators within tension assembly 400 align at the proper fraction of tension. Hence, a guy cable having a breaking strength of five thousand pounds will use a different spring in tension assembly 400 than a guy cable having a breaking strength of ten thousand pounds. The spring used within the tension assembly of the present technology may be selected based on the desired tension between the structure and the anchor between which the tension assembly is coupled.

Figure 5:
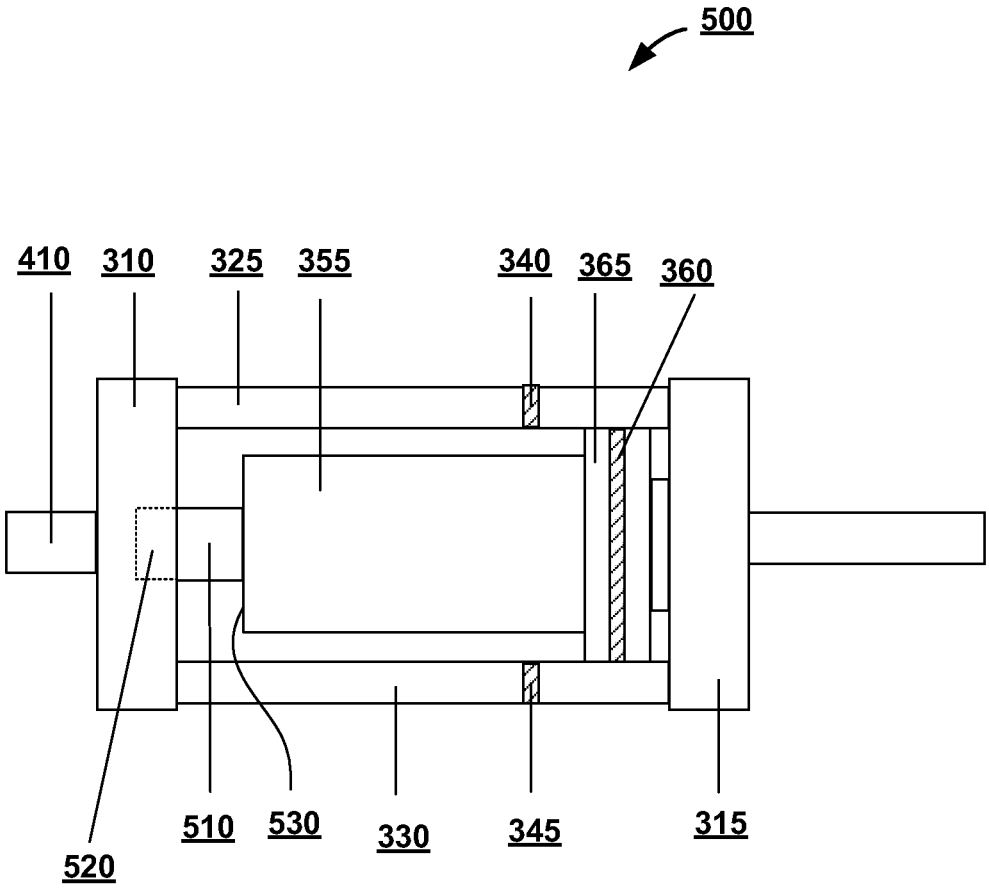
FIG. 5 illustrates an exemplary tension assembly with a spring carrier shoulder.

FIG. 5 illustrates an exemplary tension assembly with a spring carrier shoulder. Tension assembly 400 includes front plate 310, rear plate 315, support members 325 and 330, spring carrier 355, and a spring carrier end 365. Spring 350 and additional support members are not illustrated for simplicity.

The tension assembly 500 also includes a shoulder 510, shoulder cavity 520, and shoulder inner surface 530. In some instances, an increase in the tension between the structure 110 and anchor 230 may occur, whether from operator error, wind gusts or other interaction with the structure or anchor, or some other event. The tension assembly device includes a mechanism to prevent the spring from being over compressed. If an undesirably high tension increase occurs, the shoulder inner surface will engage the inner surface of front plate 310 to prevent the spring carrier from extending too far away from the outer plate. A portion of the shoulder 510 extends into shoulder cavity 520 until the shoulder inner surface and front plate inner surface engage. Once the surfaces engage, the shoulder and spring carrier will not move any further away from the rear plate, thus reducing the possibility of damage to the structure and an operator of the guy system.

Figure 6:
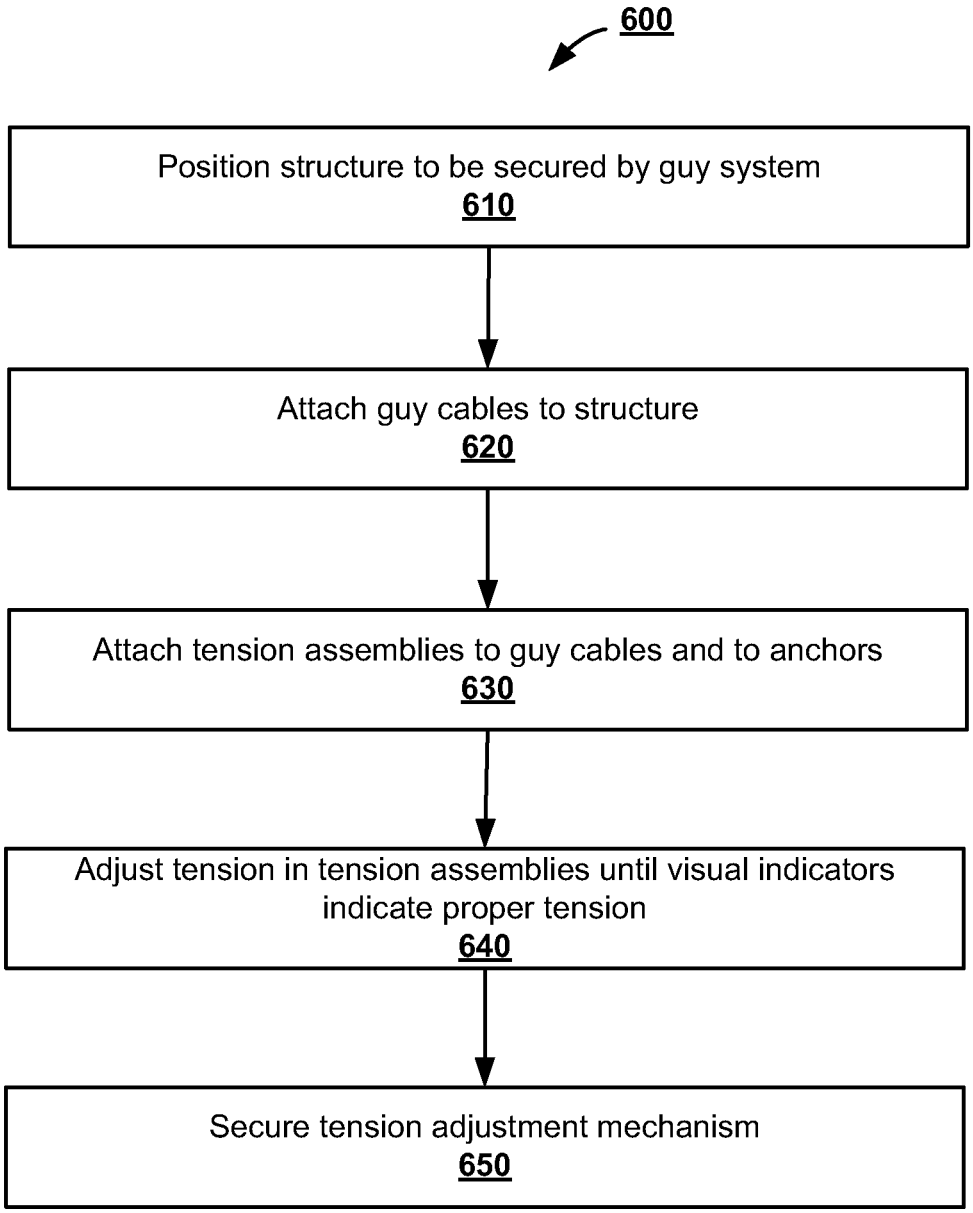
FIG. 6 illustrates an exemplary method for adjusting tension in a guy system using a tension assembly of the present technology.

FIG. 6 illustrates an exemplary method for adjusting tension in a guy system using a tension assembly of the present technology. The method of FIG. 6 may be performed by a user in association with the guy system of FIG. 2. First, a structure 110 is positioned at step 610. The structure may be positioned in an area and configuration suitable to be used with the tension assembly of the present technology. Guy cables are then attached to the structure at step 620. The cables may be attached such that, when secured with an appropriate level of tension, the guy cables support the structure in a desired position.

Tension assemblies are attached to the guy cables and to anchors at step 630. Each tension assembly has a connector for coupling to a guy cable, either directly or via a tension adjustor such as a come-along. The connector may be a bolt, hook, or other mechanism. Each tension assembly also has a connector for coupling to an anchor, either directly or through another component.

The tension between the structure 110 and each anchor is adjusted using the tension adjustor until the visual indicators indicate the proper tension is reached in each tension assembly at step 640. Adjusting the tension may include using a hand level of a come-along device to pull a cable attached to a structure (or anchor), thereby increasing the tension between the structure and the anchor. As the tension is increased between the structure and an anchor, the indicators will slowly come closer to alignment. For example, as a come-along is used to pull in a cable, an indicator on a spring carrier end will be moved closer to the indicator on a support bar. Once the indicators are aligned, the tension between the structure and the anchor is set to the desired level. One of ordinary skill in the art will realize that adjusting tension in one of several cables attached to a structure may adjust the tension on the other cables, which may then have to be adjusted. The tension assembly of the present technology allows for quick visual confirmation of the tension, however, and can be read (by identifying alignment of the indicators) and adjusted much easier than previous tension measurement mechanisms. Once the visual indicators are satisfactorily aligned in the tension assemblies, the tension adjustment mechanism may be secured so as it does not cause any changes in the tension between the structure 110 and corresponding anchor.

The invention has been described herein in terms of several preferred embodiments. Other embodiments of the invention, including alternatives, modifications, permutations and equivalents of the embodiments described herein, will be apparent to those skilled in the art from consideration of the specification, study of the drawings, and practice of the invention. The embodiments and preferred features described above should be considered exemplary, with the invention being defined by the appended claims, which therefore include all such alternatives, modifications, permutations and equivalents as fall within the true spirit and scope of the present invention.

What is claimed is:

1. A guy system, comprising:

a guy cable assembly including a guy cable, a tension adjuster, and a tension sensing device connected in series;

the tension sensing device including:

a first plate forming a first end of the tension sensing device;

a second plate spaced apart from and attached to the first plate by at least one support member, the second plate having an aperture formed therethrough;

a spring carrier disposed between the first plate and the second plate and having a first end passing through the aperture in the second plate, the first end of the spring carrier forming a second end of the tension sensing device;

a spring disposed between the first and second plates, the spring having a first end attached to a second end of the spring carrier and a second end resting on an inner face of the second plate so as to undergo compression when tensile force is exerted on the guy cable assembly; and at least one visual indicator disposed on the tension sensing device at a position to indicate that the spring is compressed between the first and second plates by an amount that corresponds to a specific tensile force exerted on the guy cable assembly, the at least one visual indicator including a first indicator having a fixed position with respect to the first and second plates, and a second indicator having a fixed position with respect to the spring carrier, wherein a predetermined spatial relationship between the first and second indicators indicates the specific tensile force exerted on the guy cable.

2. The tension assembly device of claim 1, wherein the predetermined spatial relationship is lateral alignment.

3. The tension assembly device of claim 1, wherein:

the spring is a coil spring; and the spring carrier is disposed in an inner void defined by the coil spring.

4. The tension assembly device of claim 1, wherein the spring carrier includes a shoulder, the shoulder having a surface configured to engage an inner surface of the second plate to stop movement of the spring carrier past a limit and prevent further compression of the spring at a position where the shoulder surface and the inner surface of the second plate are engaged.

5. A guy system, comprising:

a tower having a plurality of guy attachment points;

a plurality of guy anchors disposed around a base of the tower, each guy anchor aligned with one of the plurality of attachment points of the tower to form a guy anchor attachment point pair;

a plurality of guy cable assemblies, each guy cable assembly attached between a different one of the guy anchor attachment point pair pairs and including a guy cable, a tension adjuster, and a tension sensing device connected in series;

each tension sensing device including:

a first plate forming a first end of the tension sensing device;

a second plate spaced apart from and attached to the first plate by at least one support member, the second plate having an aperture formed therethrough;

a spring carrier disposed between the first plate and the second plate and having a first end passing through the aperture in the second plate, the first end of the spring carrier forming a second end of the tension sensing device;

a spring disposed between the first and second plates, the spring having a first end attached to a second end of the spring carrier and a second end resting on an inner face of the second plate so as to undergo compression when tensile force is exerted on the guy cable assembly; and at least one visual indicator disposed on the tension sensing device at a position to indicate that the spring is compressed between the first and second plates by an amount that corresponds to a specific tensile force exerted on the guy cable assembly, the at least one visual indicator including a first indicator having a fixed position with respect to the first and second plates, and a second indicator having a fixed position with respect to the spring carrier, wherein a predetermined spatial relationship between the first and second indicators indicates the specific tensile force exerted on the guy cable.

6. The A guy system of claim 5, wherein the predetermined spatial relationship is lateral alignment.

7. The A guy system of claim 5, wherein:

the spring is a coil spring; and the spring carrier is disposed in an inner void defined by the coil spring.

8. The A guy system of claim 5, wherein the predetermined relationship is lateral alignment.

9. The A guy system of claim 5, wherein the spring carrier includes a shoulder, the shoulder having a surface configured to engage an inner surface of the second plate to stop movement of the spring carrier past a limit and prevent further compression of the spring at a position where the shoulder surface and the inner surface of the second plate are engaged.

* * * * *